US005328423A

United States Patent [19]

Abboudi et al.

[11] Patent Number: 5,328,423

[45] Date of Patent: Jul. 12, 1994

[54] UNDERWATER STAIR CLIMBING EXERCISE APPARATUS

[76] Inventors: Shalom Y. Abboudi, 126 N. 9th Ave., Highland Park, N.J. 08904; Robert Adley, 18 Mendingwall Cir., Madison, Conn. 06443

[21] Appl. No.: 934,007

[22] Filed: Aug. 21, 1992

[51] Int. Cl.[5] ..... A63B 21/008; A63B 22/04

[52] U.S. Cl. ..... 482/53; 482/111

[58] Field of Search ..... 482/51-53, 482/111-113, 54

[56] References Cited

U.S. PATENT DOCUMENTS 5,060,935 10/1991 Dunn et al. ..... 482/53
5,116,295 5/1992 Dunn et al. ..... 482/53
5,125,879 6/1992 Kuo ..... 482/111

*Primary Examiner*—Stephen R. Crow
*Attorney, Agent, or Firm*—Henry I. Schanzer

[57] ABSTRACT

A stair climbing exercise apparatus for use within a pool of water comprises two steps mounted for reciprocal movement along vertically disposed guides, pulleys disposed at an upper end of the guides, and a cable interconnecting the two steps and extending around the pulleys. Mounted on each of the steps, for movement therewith, is a flap having a relatively large surface disposed perpendicularly to the direction of movements of the steps. In use, when one of the steps is moved downwardly by the foot of a user of the apparatus, the other step is moved upwardly by the interconnecting cable. The water resists movement of the flaps, hence provides resistance to downward movement of the steps.

7 Claims, 3 Drawing Sheets

UNDERWATER STAIR CLIMBING EXERCISE APPARATUS

BACKGROUND OF THE INVENTION

This invention relates to apparatus for performing underwater therapeutic exercise and particularly to an exercise simulating a stair climbing activity.

It is recognized that therapeutic exercises, e.g., by elderly persons or persons recovering from an illness or accident, are often best performed within a water environment wherein the weight of the exerciser's body is at least partially supported by the water while selected portions of the body are exercised. This allows selective exercising while reducing unwanted stresses.

One exercise which is particularly best performed within a body of water by persons undergoing physical therapy is that of stair climbing. This is because normal stair climbing is so stressful as to be almost impractical as a therapeutic exercise unless the normally high exertions associated with it are greatly reduced.

Stair climbing exercise devices are well known and described, for example, in U.S. Pat. Nos. 3,970,302, 4,726,581, 4,708,338, 3,592,468, and 4,555,108, the subject matter of which are incorporated herein by reference.

In each of the devices of these patents, movable steps are provided which are movable in opposite directions, i.e., one being moved downwardly by the user's foot while the other moves upwardly, and vice versa. Also, each of the devices is provided with means for selectively varying the amount of force required for moving the steps.

The devices described in these patents are not designed for use under water. Proper design of apparatus for use in water, particularly water which is chemically treated, e.g., fluorinated, for hygienic purposes, must overcome several problems. For example, chemically treated water tends to be highly corrosive, thereby excluding the use of many materials and assemblages. Lubricated joints, unless hermetically sealed, are impractical. Also, to avoid the need to remove the apparatus from the pool, the parts of the apparatus should be readily removable and replaceable even if under water.

Thus, for underwater use, an apparatus should be as simple as possible, containing few parts movable with respect to one another, and including a minimum of joints requiring lubrication.

Patents, in the names of applicants herein, plus others, exist showing underwater exercize apparatus. One such patent, U.S. Pat. No. 5,098,085, shows different apparatus simulating rowing, skiing, and skating, using flap means to provide resistance to movable elements moved by the exerciser.

The present invention is directed to a stair climbing apparatus satisfying the aforementioned criteria.

SUMMARY OF THE INVENTION

A stair climbing underwater exercise device comprises two steps mounted for reciprocal movement along vertically disposed guide means, pulley means, and a cable extending around the pulley means and interconnecting the two steps, whereby when one of the steps if forced downwardly by the foot of a user, the other step is pulled upwardly by the cable. Mounted on the steps, for movement therewith, are flaps having a relatively large surface disposed perpendicularly to the direction of movements of the steps.

In use, the device is disposed within a body of water. Movement of the steps, by a person using the apparatus, causes a corresponding movement of the flaps through the water. The water provides resistance to movement of the flaps and a corresponding resistance to movement of the steps.

DESCRIPTION OF A PREFERRED EMBODIMENT OF THE INVENTION

Figure 1:
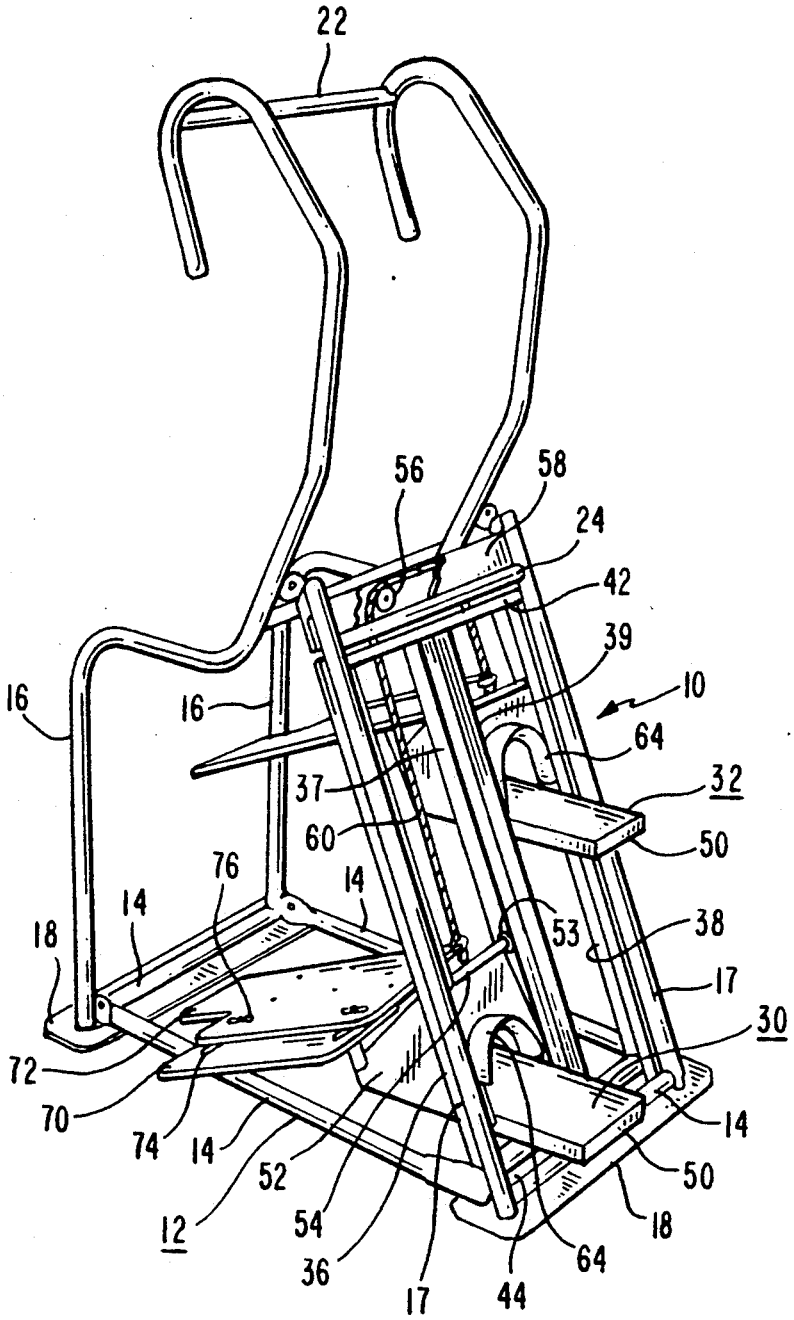
FIG. 1 is a view, in perspective and partially broken away, of a stair climbing exercise apparatus for underwater use according to one embodiment of the invention.

With reference to the drawings, an apparatus 10 in accordance with this invention comprises a bottom rectangular frame 12 including four side members 14, two pairs of support legs 16 and 17 secured to the frame 12 at corners thereof and extending upwardly from the frame 12, and a pair of support plates 18 secured to the bottom ends of pairs of legs 16 and 17 and extending beneath the front and rear ends of the frame 12.

In use, the apparatus 10 is disposed within a pool with the support plates 18 disposed on a bottom surface of the pool. As indicated in FIG. 1, the apparatus is preferably submerged more or less completely beneath the surface (20) of the water contained within the pool.

The rear legs 16 of the apparatus extend substantially vertically upwardly from the support plates 18, then bend horizontally forward towards the front of the apparatus, then continue vertically upwardly and rearwardly and finally loop downwardly. A cross bar 22 extends between the two rear legs 16 close to the uppermost portions thereof. The uppermost portions and the bar 22 serve as hand holds for a user of the apparatus.

The front legs 17 slope rearwardly and upwardly and are secured to the rear legs 16 slightly above the horizontally extending portion thereof. For added strength, another cross bar 24 extends between and is secured to the front legs 17 slightly below the points of attachment of the front legs 19 to the rear legs 16.

Mounted between the front legs 17 is a track means for a pair of movable members 30 and 32.

The track means comprises four rails 36, 37, 38, and 39 extending parallel to the front legs 17. Each rail has a generally U-shaped cross-section defining a channel extending lengthwise of the rail. Pairs of rails 36,37 and 38,39 determine the paths of movement of respective ones of the movable members 30 and 32. One rail (36,38) of each pair of rails is secured to a respective one of the front side legs 17, and the other rail (37,39) of the rail pairs are disposed in back to back relation midway between the front legs 17. All the rails are held firmly in place by means of upper 42 and lower 44 support bars extending between and secured to the side legs 17 and secured to the upper and lower ends of the rails respectively.

The movable members 30 and 32 are identical to one another. Each movable member comprises a horizontally disposed step 50 extending forwardly and rearwardly of the front legs 17 of the apparatus, and a pair of vertically extending side plates 52 rigidly secured to side surfaces of the step 50 along the rear portions thereof.

The members 30 and 32 are mounted on the track means to enable them to move up and down the tracks. Each member is provided with two axles terminating in rollers received within the channels of the various side rails 36–39.

One of the axles extends through the width of the step 50 and terminates in rollers 53 within the channels of a corresponding pair (36,37 and 38,39) of rails. The other axle extends between upper, front corners of each pair of side plates 52, through a hollow cylinder 54 extending between the plates 42 and into the channels of a corresponding pair of rails. Although neither the axles nor details of the various rollers at the ends of the axles are shown, the mounting of movable members for movement along rails via rollers within the rails is known.

The two movable members 30 and 32 are operatively connected together by means of a cable 60 connected at its ends to the cylinder 54 extending between pairs of side plates 52 and extending around a pair of pulleys 56 mounted between a pair of spaced apart plates 58 extending between and secured to the front legs 17.

By means of the interconnecting cable 60, when one of the movable members 30 and 32 is forced downwardly by a user of the apparatus, in an exercise simulating stair climbing, the other of the members is pulled upwardly by the cable. A bumper 63, e.g., of a soft plastic material, is disposed at the lower end of the tracks to provide a soft bottoming of the movable members 30 and 32.

A stirrup 64 is provided on each step for retaining the user's feet securely on the steps during use.

As mentioned, the apparatus 10 is intended for use within a body of water and, for the purpose of providing resistance to movements of the steps by the user, flap means are provided mounted on each of the steps 30 and 32.

In general, each flap means comprises a relatively large area flat plate so disposed that the major surfaces thereof extend in directions generally perpendicular to the direction of movements of the steps 50. When disposed within a body of water, the water provides resistance to movement of the flaps through the water, hence resistance to movements of the steps 50 along the track means.

By "relatively large" is meant a surface area at least equal to that of the steps, and preferably larger. That is, the surfaces of the steps 50 inherently provide resistance to movements of the steps through water but, assuming steps of a size to accommodate the feet of adult human males, e.g., steps having dimensions of 5 by 10 inches, the resistance provided by such steps is generally not sufficiently high to provide a desired degree of exercise effort. By using flaps at least as large in area as the area of the steps, the resistance to movement is at least doubled.

However, because the levels of exercise needed varies from user to user, and from time to time even with a given user as therapy proceeds, a feature of the invention is the provision of means whereby the degree of resistance to movements of the steps is adjustable, and is adjustable in an extremely simple manner.

To this end, the flap means according to this invention each comprises two overlapping plates 70 and 72, the plate 70 being securely fastened to a step 50 and the plate 72 being mounted on the plate 70 in adjustable overlapping relation therewith.

Figure 2:
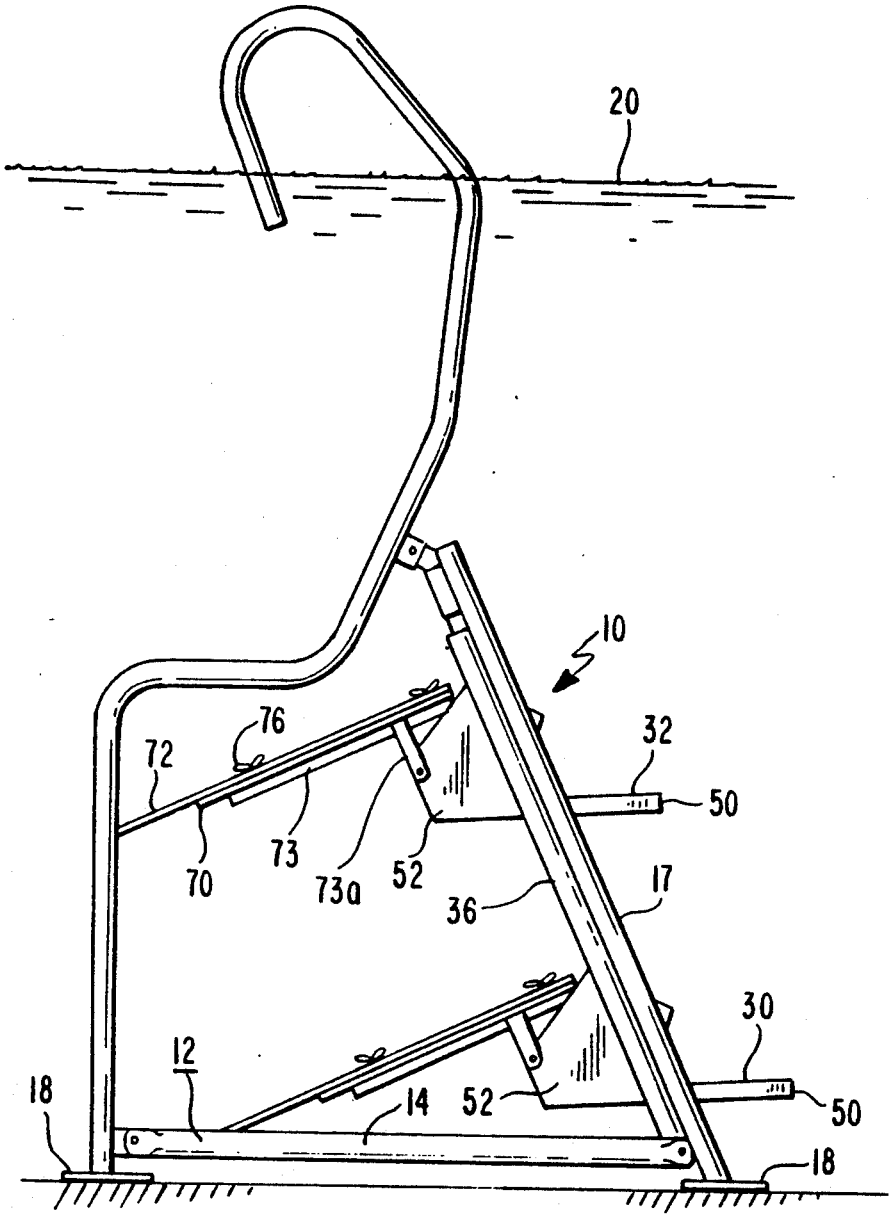
FIG. 2 is a side elevation of the apparatus shown in FIG. 1.
Figure 3:
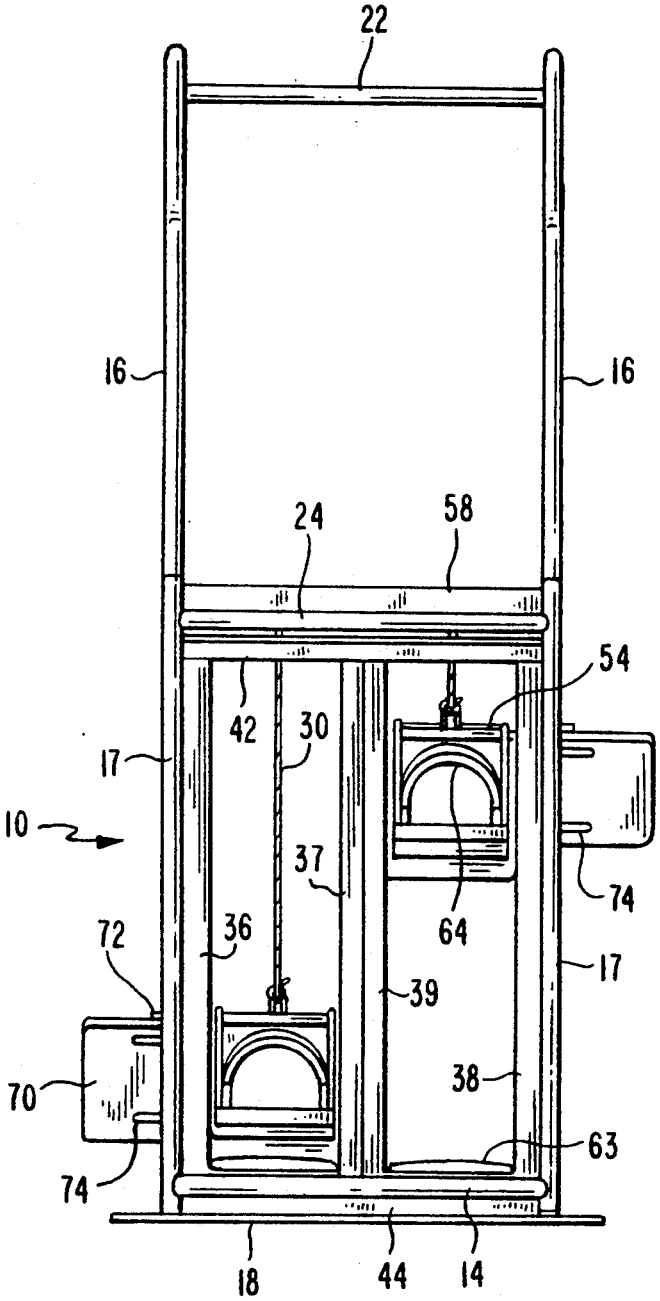
FIG. 3 is a front elevation of the apparatus.

Thus, as shown in FIGS. 1 and 2, the plate 70 is rigidly mounted, by means of support bars 73, on the upper rear corners of each pair of side plates 52 attached to each step. The major surfaces of the plates 70 are generally perpendicular to the direction of the movements of the steps. Each of the plates 70 has a pair of parallel, elongated slots 74 therethrough. The plates 72 are each mounted on a respective plate 70 parallel thereto and secured in place by bolts and wing nuts 76. By loosening the wing nuts, the plates 72 can by moved relative to the plates 71 for varying the degree of overlapping of the two plates, hence the effective surface areas presented by the two plates acting as a single flap means. The wing nuts are then tightened to maintain the relative positioning of the plates 70 and 72.

A feature of this quite simple adjusting means is that such adjustments can be made without removing the apparatus from under water and with such small exertion as to be possible without need of an underwater breathing apparatus.

In one embodiment of the invention, the fixed flap plate 70 is rectangular and has dimensions of 13.25 by 13.75 inches. The flap plate 72 is generally L-shaped, including a large rectangle having dimensions of 13.25 by 13.75 inches, and a small rectangle, 5.25 by 6.75 inches. The elongated slots 74 in the flap plates 70 extend to within 1 inch of the sides of the plates 70, whereby, when the plates 72 are positioned at their maximum extension beyond the edges of the plates 70, the composite dimensions of each of the flap means is 13.25 by 25.5 for an enlarged rectangle formed by the two plates 70 and 72, plus the 5.25 by 6.75 small rectangular portion of the plate 72 which, regardless of the degree of overlapping of the two plates 70 and 72, extend beyond the plate 70.

The flap means are thus relatively large when in their fully expanded condition, and the support frame of the apparatus is so shaped to accommodate the flap means. Thus, while the front legs 17 of the frame slope rearwardly, as in a normal flight of steps, the rear legs 16 are generally perpendicular to the horizontal to a height above the upper ends of the paths of movements of the flap means, thereby providing space for free movement of the flap means within the apparatus frame.

As mentioned, the steps 50 of the movable members 30 and 32 are disposed horizontally as are normal steps. The movements of the steps 50, however, are in a direction along the varying rails 36–39 forming the track means, which (FIG. 2) are inclined from the vertical. For maximum effectiveness of the flap means, with respect to providing resistance to movements of the movable members 30 and 32, the flap plates 70 and 72 are disposed generally perpendicular to the track means, hence at an angle relative to the horizontally disposed steps 50. In one embodiment, the slope of the track means (and of the frame front legs 17) from the horizontal is around 30 degrees, and the main planes of the flap plates 70 and 72 are sloped at around 60 degrees from the horizontal.

The flap plates 70,72 thus slope downwardly from the steps 50 in the front to rear directions. To prevent the rear-most edges of the flap plates 72 from contacting the bottom of the pool when the steps 50 are at the bottom ends of their paths, the points of attachment of the plates 70 at their forward ends are disposed at a height above the horizontal plane of the steps. This is accomplished via the side plates 52 and the vertical posts 73*a*.

Two plates can be adjusted independently so somebody can exercise one leg more than the other.

What is claimed is:

1. An exercise stair-like device for use within a body of water comprising two parallel adjacent tracks inclined from the vertical, the two tracks having a lower end and an upper end with the lower end of the parallel tracks being intended to rest on the bottom of the body of water and the upper end of the parallel tracks extending above the bottom, two steps and guide means one step per track, said steps being reciprocally movable along adjacent paths defined by said tracks, means interconnecting said two steps, upon movement of one of said steps downwardly in response to a force exerted thereon by a user of the device, the other of said steps is moved upwardly, and a flap means mounted on each of said steps and extending laterally therefrom, each of said flap means having a surface disposed generally perpendicular to the direction of movements of said steps, whereby in use of said device within a body of water, the water provides resistance to movements of said flaps along said direction and a corresponding resistance to movements of said steps along said direction.

2. A device according to claim 1 wherein each of said steps has a surface for engagement by the foot of a user of the apparatus, each said surface having a preselected area, each of said flap means having an area at least equal to the area of the surface of its corresponding step.

3. A device according to claim 2 wherein each of said flap means comprises first and second parallel and overlapping plates, the first of said plates being fixedly secured to a corresponding step and said second plate being releasably securable to said first plate, whereby the degree of overlap between said first and second plates can be selectively varied.

4. A device according to claim 1, wherein said tracks are supported by means of an inverted "L" shaped member having a first generally vertical portion designed to rest at one end on the bottom of the body of water, and having a second generally horizontal portion connected between said vertical portion and the upper end of said tracks.

5. A device according to claim 4, further including a structural member connected between said one end of said vertical portion of said "L" shaped member and the lower end of said tracks.

6. A device according to claim 4, wherein said "L" shaped member is so shaped to enable said flap means to be extendable for virtually the full distance between the tracks and the vertical portion of the "L" shaped member.

7. A device according to claim 1, wherein said two steps are interconnected by a pulley-like means, whereby when one step is moved downwardly, the other end is moved upwardly.

* * * * *